US007083011B2

(12) United States Patent
Meyer

(10) Patent No.: US 7,083,011 B2
(45) Date of Patent: Aug. 1, 2006

(54) FLUID DRILLING HEAD

(75) Inventor: Timothy Gregory Hamilton Meyer, New South Wales (AU)

(73) Assignee: CMTE Development Limited, Brisbane (AU)

( * ) Notice: Subject to any disclaimer, the term of this patent is extended or adjusted under 35 U.S.C. 154(b) by 0 days.

(21) Appl. No.: 10/495,725

(22) PCT Filed: Nov. 14, 2002

(86) PCT No.: PCT/AU02/01550

§ 371 (c)(1),
(2), (4) Date: May 14, 2004

(87) PCT Pub. No.: WO03/042491

PCT Pub. Date: May 22, 2003

(65) Prior Publication Data

US 2005/0034901 A1 Feb. 17, 2005

(30) Foreign Application Priority Data

Nov. 14, 2001 (AU) ..... PR8864

(51) Int. Cl.
*E21B 7/18* (2006.01)

(52) U.S. Cl. ..... 175/424; 175/67; 166/223

(58) Field of Classification Search ..... 175/67, 175/424; 166/223
See application file for complete search history.

(56) References Cited

U.S. PATENT DOCUMENTS

| | | | | |
|---|---|---|---|---|
| 1,435,144 A | | 11/1922 | Bignell | |
| 1,660,999 A | | 2/1928 | Macdonell | |
| 1,865,853 A | | 7/1932 | Granville | |
| 2,282,431 A | | 5/1942 | Smith et al. | |
| 2,516,421 A | | 7/1950 | Robertson | |
| 3,191,697 A | | 6/1965 | Haines | |
| 3,844,362 A | | 10/1974 | Elbert et al. | |
| 3,858,398 A | | 1/1975 | Van Weele | |
| 3,873,156 A | | 3/1975 | Jacoby | |
| 3,874,733 A | | 4/1975 | Roundstone et al. | |
| 3,881,775 A | | 5/1975 | McPherson et al. | |
| 3,887,021 A | | 6/1975 | Elbert | |
| 3,917,007 A | * | 11/1975 | Tsiferov | 175/14 |
| 4,007,797 A | | 2/1977 | Jeter | |

(Continued)

FOREIGN PATENT DOCUMENTS

DE 3012482 A1 10/1981

(Continued)

OTHER PUBLICATIONS

Derwent Abstract Accession No. K7867B/46, Class Q49, SU 649815, A (UKR Col Hydr Minin) Feb. 28, 1979.

(Continued)

*Primary Examiner*—David Bagnell
*Assistant Examiner*—G M Collins
(74) *Attorney, Agent, or Firm*—Perkins Coie LLP

(57) ABSTRACT

A fluid drilling head has a plurality of nozzles (3, 4, 5, 6) in a rotatable nozzle assembly (2) to provide high pressure cutting jets (7). The head is provided with a gauging ring (10) having an annular clearance (11) to the rotatable nozzle assembly (2) to provide for the passage of rock particles eroded by the cutting action of the jets (7) while regulating the progress of the drilling head in the borehole and controlling drill stalling. A stepped rotatable nozzle assembly having a smaller diameter portion (8) and a larger diameter portion (9) to extend the cutting zone of a reaming jet closer to the outer diameter of the gauging ring (10) is also described and claimed.

8 Claims, 1 Drawing Sheet

U.S. PATENT DOCUMENTS

| | | | | |
|---|---|---|---|---|
| 4,273,193 | A | | 6/1981 | Tompkins |
| 4,437,706 | A | | 3/1984 | Johnson |
| 4,440,242 | A | | 4/1984 | Schmidt et al. |
| 4,458,766 | A | | 7/1984 | Siegel |
| 4,497,381 | A | | 2/1985 | Dickinson |
| 4,503,918 | A | | 3/1985 | Bergkvist |
| 4,527,639 | A | | 7/1985 | Dickinson |
| 4,640,362 | A | | 2/1987 | Schellstede |
| 4,674,579 | A | | 6/1987 | Geller |
| 4,714,118 | A | | 12/1987 | Baker |
| 4,754,526 | A | * | 7/1988 | Tremoulet et al. ..... 175/424 |
| 4,765,416 | A | | 8/1988 | Bjerking |
| 4,773,113 | A | | 9/1988 | Russell |
| 4,826,087 | A | | 5/1989 | Chinery |
| 4,850,440 | A | | 7/1989 | Smet |
| 4,930,586 | A | | 6/1990 | Turin |
| 4,991,667 | A | | 2/1991 | Wilkes |
| 5,179,753 | A | | 1/1993 | Flaherty |
| 5,197,783 | A | | 3/1993 | Theimer |
| 5,255,750 | A | | 10/1993 | Wilkes |
| 5,288,173 | A | | 2/1994 | Jenne |
| 5,413,184 | A | | 5/1995 | Landers |
| 5,439,066 | A | | 8/1995 | Gipson |
| 5,814,162 | A | | 9/1998 | Barrett |
| 5,853,056 | A | | 12/1998 | Landers |
| 5,899,283 | A | | 5/1999 | Cox |
| 5,950,743 | A | | 9/1999 | Cox |
| 5,992,547 | A | | 11/1999 | Caraway et al. |
| 6,012,536 | A | | 1/2000 | Puttmann |
| 6,089,336 | A | | 7/2000 | Nexton et al. |
| 6,109,370 | A | | 8/2000 | Gray |
| 6,231,270 | B1 | | 5/2001 | Cacossa |
| 6,263,984 | B1 | | 7/2001 | Buckman |
| 6,470,978 | B1 | | 10/2002 | Trueman |
| 6,530,439 | B1 | | 3/2003 | Mazorow |
| 2003/0164253 | A1 | | 9/2003 | Trueman |

FOREIGN PATENT DOCUMENTS

| | | | |
|---|---|---|---|
| FR | 2493907 | | 5/1982 |
| GB | 2289298 | A | 11/1995 |
| JP | 06346676 | A | 12/1994 |
| RU | 1093062 | | 8/1994 |
| WO | WO-95/09963 | | 4/1995 |
| WO | WO-97/21900 | | 6/1997 |
| WO | WO-03/042491 | | 5/2003 |

OTHER PUBLICATIONS

Maramzin, A.V., "Automation and Mechanization of Tripping Process (Review of Foreign patents)", pp. 83-84.

European Patnet Search Report for Application No. EP02776601; dated Nov. 9, 2004; European Patent Office.

* cited by examiner

FLUID DRILLING HEAD

FIELD OF THE INVENTION

This invention relates to a fluid drilling head and has been devised particularly though not solely for use in fluid drilling apparatus of the type described in Australian patent specification 700032, the content of which is incorporated herein by way of cross reference.

BACKGROUND OF THE INVENTION

In fluid drilling apparatus in general, and in particular in apparatus of the type described in Australian patent specification AU700032, the rock through which a bore hole is being formed by fluid jet erosion is often hard and difficult to cut or erode by water jet action.

It is a problem with fluid drilling apparatus of this type that the forward progress of the cutting head is difficult to regulate due to the inconsistent nature of the rock being cut. It is common for the cutting head to be held up in areas of harder rock, causing over reaming of the surrounding rock in this area until the rock in front of the head is cleared sufficiently to enable the cutting head to advance, whereupon the cutting head surges forward resulting in inconsistent and uneven diameter of the bore being cut.

In waterjet drilling practice using a drill similar to that described in Australian patent specification AU700032 the high pressure waterjets cut the rock ahead of the drill forming rock chips called cuttings. The spent jet fluid then flows back along the borehole, firstly through the annulus formed between the body of the drill and the borehole wall and then through the much larger annulus formed between the high pressure supply hose and the borehole wall. The cuttings are carried along in the flow of this spent jet fluid. The volumetric flow rate of the waterjets is constant for a given combination of pump pressure and nozzle diameter, whilst the rate of cuttings produced is determined by the drill penetration rate and the borehole diameter.

In order for the spent jet fluid and the cuttings to flow back through the annular area formed by the body of the tool and the borehole wall a pressure differential is required across the length of the tool. Hence, a higher pressure acts on the front surface area of the drill compared to the back surface area. The magnitude of this pressure differential is determined by the equivalent flow area of the annulus, the volumetric flow rate of the spent jet fluid and cuttings, and the length of the tool body. If the equivalent flow area of the annulus is sufficiently small then the resultant pressure differential is sufficiently large as to create a backward acting force greater than the net forward force created by the retro-jets. This will stop the advancement of the drill, possibly even resulting in the drill being forced backwards. This is referred to as "drill stalling".

Two separate but related situations can cause the tool to stall. Firstly, if the diameter of the cut borehole is below a critical value, then the tool will stall. Secondly, if cuttings particles larger than the annular relief are generated, they can partly block the annulus region thereby reducing the equivalent flow area causing the tool to stall.

There is also a conflict of requirements in the area of the rotatable nozzle assembly of the fluid cutting head between leaving sufficient clearance for particles of rock eroded by the water jet action to clear the rotating nozzle assembly and be carried rearwardly in the fluid flow, and the necessity to locate the outlet from the high pressure fluid jet nozzles as close to the rock face as possible in order to optimise the cutting force.

SUMMARY OF THE INVENTION

Accordingly, the present invention provides a fluid drilling head of the type having a plurality of nozzles in a rotatable nozzle assembly, said nozzles being adapted to be supplied with high pressure fluid forming jets positioned to cut adjacent rock and angled to provide a reactive force arranged to rotate the nozzle assembly, the head being provided with a gauging ring concentrically located relative to the rotatable nozzle assembly and positioned behind the jets relative to the direction of advance of the drilling head, the gauging ring having an overall circumference sized to fit within the desired section of the bore being drilled by the drilling head.

Preferably the gauging ring is generally cylindrical in configuration having an annular clearance to the rotatable nozzle assembly, the clearance being sized to permit the flow of rock particles eroded by the cutting action of the fluid jets between the gauging ring and the rotatable nozzle assembly.

Preferably the body of the fluid drilling head located behind the gauging ring relative to the direction of advance of the drilling head, is longitudinally fluted, the flutes providing longitudinal channels for the passage of said rock particles along the length of the drilling head.

Preferably the channels are separated by longitudinal ribs sized and configured to provide a desired degree of lateral alignment of the drilling head within the bore being formed by the action of the drilling head.

Preferably the rotatable nozzle assembly is generally cylindrical in configuration and stepped to incorporate portions of different diameters such that the outlets from nozzles located in different said portions are located at different radii from the axis of rotation of the rotatable nozzle assembly.

Preferably the cylindrical rotatable nozzle assembly has portions of two different diameters, there being a smaller diameter portion adjacent the leading face of the rotatable nozzle assembly, and a larger diameter portion adjacent the gauging ring.

Preferably the smaller diameter portion of the rotatable nozzle assembly incorporates one or more forwardly angled nozzles adapted to erode rock in advance of the forward movement of the fluid drilling head.

Preferably the larger diameter portion incorporates at least one reaming nozzle arranged to direct a fluid jet against the periphery of the bore hole immediately in advance of the leading edge of the gauging ring.

BRIEF DESCRIPTION OF THE DRAWINGS

Notwithstanding any other forms that may fall within its scope, one preferred form of the invention will now be described by way of example only with reference to the accompanying drawings in which.

DETAILED DESCRIPTION OF PREFERRED EMBODIMENTS OF THE INVENTION

Figure 2:
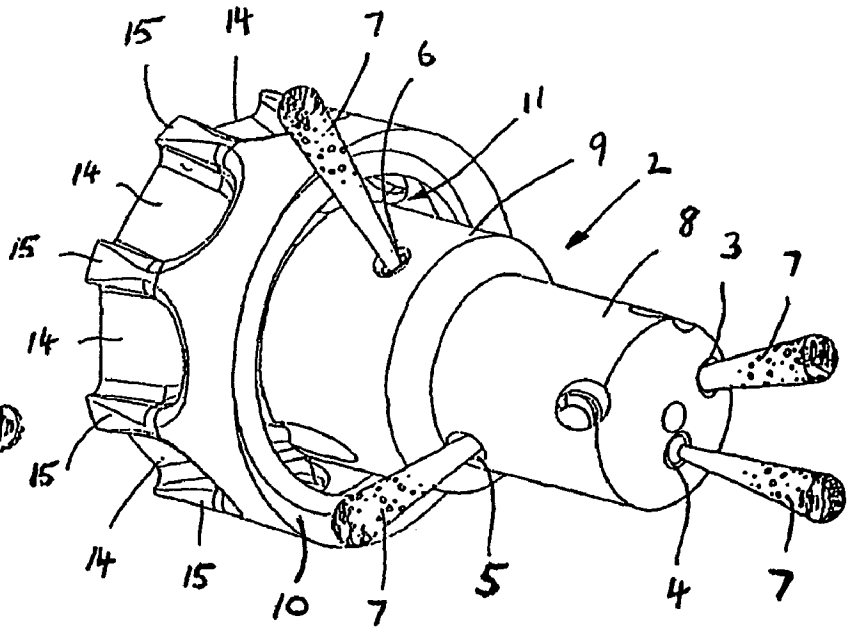
FIG. 2 is a perspective view of the fluid drilling head shown in FIG. 1.

In the preferred form of the invention, the leading end of a fluid drilling head generally shown at 1 is provided with a rotatable nozzle assembly 2 which is generally cylindrical in configuration as can be clearly seen in FIG. 2. The rotatable nozzle assembly incorporates a number of nozzles 3, 4, 5 and 6 from which issue high pressure jets 7 of fluid, typically water. The pressure of the jets is sufficient to erode rock in the area of the drilling head for the formation of a bore through the rock in the manner described in Australian patent specification 700032.

In the present invention, the rotatable nozzle assembly 2 is stepped into two portions having a leading portion of lesser diameter 8 and a trailing portion of greater diameter 9. It will be appreciated that the nozzle assembly could be divided into a larger number of stepped portions of different diameters if desired.

In this manner each jet 7 is positioned at a variety of radii from the axis of rotation of the rotatable nozzle assembly 2, and each jet is angled such that its effective cutting zone overlaps the effective cutting zone of the adjoining jets, or in the case of the outer most jet issuing from nozzle 6, the effective cutting zone extends to the outer diameter of a gauging ring 10 described further below.

The fluid drilling head is further provided with a gauging ring 10 which is generally cylindrical in configuration having an internal annular clearance 11 to the largest diameter portion 9 of the rotatable nozzle assembly. The annular clearance 11 is sized to control the flow of rock particles larger than a predetermined size, eroded by the cutting action of the fluid jets 7, between the gauging ring 10 and the rotatable nozzle assembly.

The body of the fluid drilling head located in region 12 behind the gauging ring 10 relative to the direction of advance of the drilling head as shown by arrow 13, is longitudinally fluted. The flutes provide longitudinal channels 14 separated by longitudinal ribs 15 which extend the length of the fluid drilling head of the type described in AU700032. Although the remainder of the fluid drilling head is not shown in the accompanying drawings, it will be appreciated that the fluted configuration extends rearwardly well beyond the portion shown in the drawings, and may be straight, helical, or of any other desired configuration.

The longitudinal channels 14 provide a clear passage for rock particles flushed past the drilling head by the water which has issued as jets 7 while the ribs 15 not only direct the rock particles, but also serve to align the drilling head within the bore which has been formed by the eroding action of the jets 7. In this manner it is possible to tailor the size and configuration of the ribs 15, particularly relative to the overall diameter of the gauging ring 10 in order to limit the degree of canting of the drilling head within the bore.

By providing the gauging ring 10, the fluid drilling head is not able to advance within the bore until the periphery of the bore has been sufficiently reamed out to the desired diameter by the action of the jet issuing from nozzles 5 and 6. The jet issuing from nozzle 6 is orientated to extend to the gauging ring diameter and the combination of the reaming jets and the gauging ring provide a clean and relatively uniform bore in the rock.

The gauging ring is effective to control the forward movement of the drilling head, preventing over-reaming of the rock bore in areas of softer rock by allowing more rapid advance of the head.

The gauging ring, cutting head and tool body designs are aimed at eliminating the issue of drill stalling. Because the leading edge of the gauging ring 10 has an external diameter slightly larger than the diameter of the drilling tool body section, this sets an elevated lower limit of the equivalent flow area of the annulus formed between the body of the drilling tool and the borehole wall.

Furthermore, the provision of the flow channels 14 along the body of the tool increase the equivalent flow area of the annulus, thereby reducing the likelihood of the drill stalling.

The annulus formed between the inside surface of the gauging ring and the larger diameter portion of the cutting head also limits the size of cuttings particles which can pass through to the annulus region between the drilling tool body and the borehole wall. Particles which are too large stay in front of this inner annulus region where they can be further broken up by the action of the waterjets, in particular jet number 6. In this manner, by suitably selecting the relative diameter of the largest portion of the cutting head, and the inner surface of the gauging ring, the particles passing along the body of the tool can be suitably sized so as they may pass freely along the flow channels. This eliminates the possibility of these particles reducing the equivalent flow area of the annulus between the drilling tool and the borehole wall.

By providing a stepped rotatable nozzle assembly 2, it is possible to position the reaming nozzle 6 closer to the face of the rock being cut than previously possible, increasing the effectiveness of the reaming jet and allowing more rapid and uniform advance of the fluid drilling head.

Figure 1:
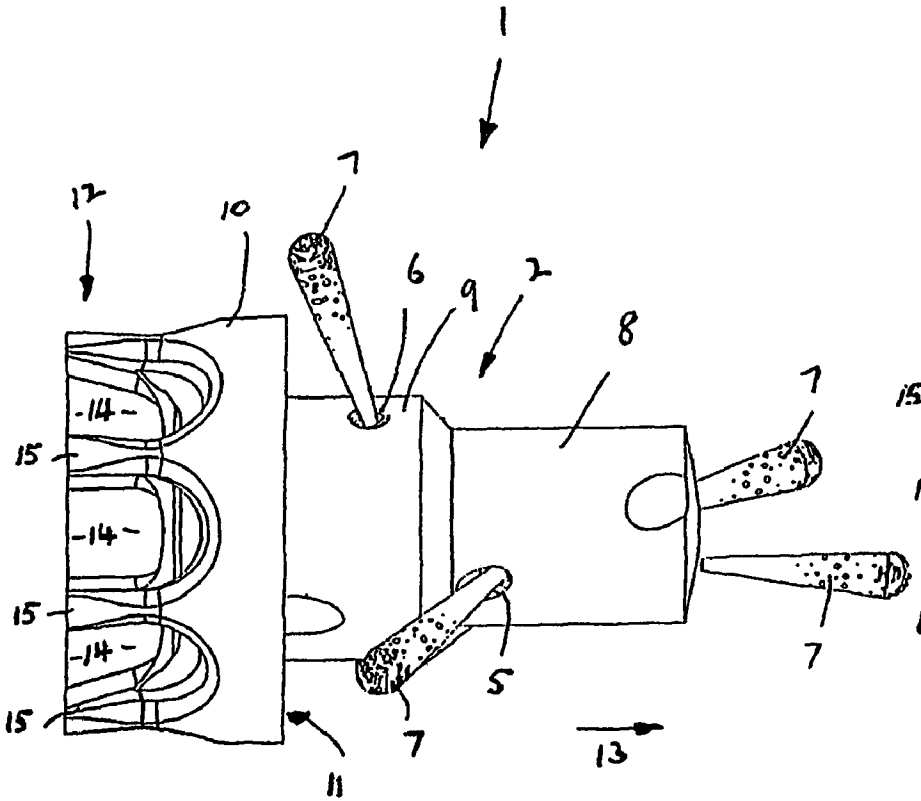
FIG. 1 is a side view of the fluid drilling head according to the invention.

The stepped rotatable nozzle assembly also enables a number of the reaming jets to be angled rearwardly as can be clearly seen in FIG. 1 for the jets issuing from nozzles 5 and 6. This augments the forward thrust on the drilling head and helps to counteract the rearward thrust from nozzles 3 and 4.

The invention claimed is:

1. A fluid drilling head of the type having a plurality of nozzles in a rotatable nozzle assembly, said nozzles being adapted to be supplied with high pressure fluid forming jets positioned to cut adjacent rock and angled to provide a reactive force arranged to rotate the nozzle assembly, the head being provided with a gauging ring concentrically located relative to the rotatable nozzle assembly and positioned behind the jets relative to the direction of advance of the drilling head, the gauging ring having an overall circumference sized to fit within the desired section of the bore being drilled by the drilling head, the gauging ring being generally cylindrical in configuration and having a radial, annular clearance to the rotatable nozzle assembly, the clearance being sized to permit the flow of rock particles eroded by the cutting action of the fluid jets between the gauging ring and the rotatable nozzle assembly.

2. A fluid drilling head as claimed in claim 1 wherein the body of the fluid drilling head located behind the gauging ring relative to the direction of advance of the drilling head, is longitudinally fluted, the flutes providing longitudinal channels for the passage of said rock particles along the length of the drilling head.

3. A fluid drilling head as claimed in claim 2 wherein the channels are separated by longitudinal ribs sized and configured to provide a desired degree of lateral alignment of the drilling head within the bore being formed by the action of the drilling head.

4. A fluid drilling head as claimed in claim 1 wherein the rotatable nozzle assembly is generally cylindrical in configuration and stepped to incorporate portions of different diameters such that the outlets from nozzles located in different said portions are located at different radii from the axis of rotation of the rotatable nozzle assembly.

5. A fluid drilling head as claimed in claim 4 wherein the cylindrical rotatable nozzle assembly has portions of two different diameters, there being a smaller diameter portion adjacent the leading face of the rotatable nozzle assembly, and a larger diameter portion adjacent the gauging ring.

6. A fluid drilling head as claimed in claim 5 wherein the smaller diameter portion of the rotatable nozzle assembly incorporates one or more forwardly angled nozzles adapted to erode rock in advance of the forward movement of the fluid drilling head.

7. A fluid drilling head as claimed in claim 5 wherein the larger diameter portion incorporates at least one reaming nozzle arranged to direct a fluid jet against the periphery of the bore hole immediately in advance of the leading edge of the gauging ring.

8. The fluid drilling head of claim 1 wherein the clearance is between an inside diameter of the gauging ring and an outside diameter of the rotatable nozzle assembly, and is sized to permit the axial flow of rock particles.

* * * * *